US006102729A

United States Patent [19]

Daoud

[11] Patent Number: 6,102,729

[45] Date of Patent: Aug. 15, 2000

[54] ELECTRICALLY-CONDUCTIVE UNIVERSAL CONNECTOR AND CONNECTOR ASSEMBLY

[75] Inventor: Bassel H. Daoud, Parsippany, N.J.

[73] Assignee: Lucent Technologies, Inc., Murray Hill, N.J.

[21] Appl. No.: 09/064,670

[22] Filed: Apr. 23, 1998

[51] Int. Cl.[7] ..... H01R 4/24

[52] U.S. Cl. ..... 439/402; 439/719

[58] Field of Search ..... 439/715–719, 439/402, 404, 441

[56] References Cited

U.S. PATENT DOCUMENTS

| | | | |
|---|---|---|---|
| 2,848,704 | 8/1958 | Obst | 439/712 |
| 3,234,498 | 2/1966 | Logan | 439/402 |
| 3,605,071 | 9/1971 | Sedlacek | 439/402 |
| 3,798,587 | 3/1974 | Ellis, Jr. et al. | 439/404 |
| 5,127,845 | 7/1992 | Ayer et al. | 439/395 |
| 5,412,715 | 5/1995 | Volpe | 439/402 |
| 5,575,680 | 11/1996 | Suffi | 439/404 |

*Primary Examiner*—Hien Vu
*Attorney, Agent, or Firm*—Synnestvedt & Lechner LLP

[57] ABSTRACT

A universal connector having a terminal configuration which may accommodate at least a wire-wrap connection, an insulation displacement connector connection or a printed wiring board connection. The connector is a unitary body formed from a relatively thin, electrically-conductive material. The connector has a pair of tines protruding in side-by-side relationship from a base portion which can be used to make insulation displacement connections. A first tine of the pair of tines has a projecting end portion extending beyond a second tine. The projecting end portion is capable of forming an electrically-conductive connection with an electrical conductor. A connector assembly is also provided which includes an insulative mounting block and a plurality of universal connectors mounted thereon.

18 Claims, 4 Drawing Sheets

ELECTRICALLY-CONDUCTIVE UNIVERSAL CONNECTOR AND CONNECTOR ASSEMBLY

FIELD OF THE INVENTION

This invention relates to electrically-conductive connectors for forming electrical connections. More particularly, this invention relates to electrically-conductive connectors and connector assemblies of the type used in telecommunications applications for terminating telephone lines, while not limited thereto.

BACKGROUND OF THE INVENTION

The present invention is described initially in the context of telecommunications applications but, as described below, is a multiple application connector assembly which may also be used to form electrical connections in other applications. In the context of telecommunications, examples of widely accepted connector assemblies are shown in U.S. Pat. Nos. 3,957,335 to Troy, 5,127,845 to Ayer et al. and 5,575,680 to Suffi. A connector assembly typically comprises an electrically insulative mounting block in which a plurality of electrically-conductive connectors are held in a standard predetermined spaced relationship. One well-known example is a type-66 connector assembly.

In telecommunications applications, such connector assemblies are commonly mounted on a panel or in a building entrance protector ("BEP") utility box. The BEP serves as an interface between the telephone company's lines and the customer's lines. The connector assembly is typically mounted with a back end of each connector exposed behind one side of the panel and a front end exposed in front of the panel. A telecommunications wire bundle from a telephone company leads into a splice chamber of the BEP. In the splice chamber, the wires are unbundled and electrically coupled to a surge protector field within the BEP. Wires leading from the surge protector are electrically coupled to the back ends of the connectors in the connector assembly.

Wires leading from the building's telephone wiring infrastructure are electrically coupled to the front ends of the appropriate connectors in the connector assembly to connect the individual customers' telephone lines with the telephone company's lines in the wire bundle. The connector assembly has applicability in other applications such as in alarm systems in which a multiplicity of electrical conductors are to be electrically coupled.

The individual electrically-conductive connectors of the connector assembly may be constructed in a variety of terminal shapes, depending upon the connection method to be used. In telecommunications applications, connectors having a wire-tail terminal configuration and an insulation displacement connector ("IDC") terminal configurations are common. However, in other applications, connectors having pin terminal configurations are used.

Wire-tail terminal configurations are used when a wire-wrap connection is desirable. A wire-tail terminal has an elongated portion which is typically 40 to 50 mils square in cross-section. A wire-wrap gun or device can be used to tightly wrap an uninsulated end portion of a wire around the wire-tail. This forms a secure connection which is desirable for use with alarms and telecommunications applications.

Another type of connector configuration is the insulation displacement connector ("IDC") terminal configuration. Typical IDC's are disclosed in U.S. Pat. Nos. 5,127,845 and 5,575,680. IDC terminals generally have a pair of tines projecting from a common base portion with a narrow slot between them. When the insulated wire conductor is forced into the slot between the tines, relatively sharp corner edges of the tines break through the insulation to tightly hold and form an electrically-conductive connection with the wire.

A third type of connector configuration having a pin terminal is used to connect to a printed wiring board ("PWB"). Pin terminals and the PWB are electrically coupled by inserting the pins into openings in the PWB and soldering the pins to the circuits on the circuit board. A PWB connection is often desirable in applications where numerous electrical connections are to be made.

It has heretofore been necessary to manufacture a wide variety of connector assemblies, each with its own type of electrically-conductive connector for use in various applications. For example, manufacturers have produced connector assemblies having two ended connectors with various combinations of terminal configurations, e.g., wire-tail terminals on both ends, wire-tail terminals on one end and IDC terminals on the other end, wire-tail terminals on one end and pin terminals on the other end. A particular example are connector assemblies use for interfacing between the telephone network and the lines in a customers building in which connectors have wire tail connections on one end, which are easily made in the factory, and IDC connections on the other end which are made in the field. Each end of the connector, however, is generally limited to a specific type of terminal, i.e., wire wrap, IDC, etc.

There is presently no known single connector end which can be used with multiple types of terminal connections for any application. Thus multiple types of connectors and connector assemblies must be produced and warehoused for the various applications.

SUMMARY OF THE INVENTION

Accordingly, my invention provides a versatile connector assembly with electrically-conductive universal connectors which can accommodate multiple types of connections such as wire-wrap, IDC and printed wiring board connections. This reduces manufacturing costs by manufacture of a single connector assembly suitable to the needs of the users of such connectors.

The invention, in one aspect, provides an electrically-conductive universal connector having a unitary body formed from a relatively thin electrically conductive material and which has a base portion. The conductor has a first end which includes a first pair of tines protruding from the base in side-by-side relationship, the pair of tines including a first and a second tine. The pair of tines are biased against separation from one another and define between them a wire-receiving slot configured for displacing insulation from and conductively gripping a wire positioned therebetween. A projecting end portion integrally attached to the first tine extends beyond the second tine a suitable length to be capable of forming an electrically conductive connection with an electrical conductor contacted therewith. The pair of tines can be used for making an IDC-type connection if so desired, or the projecting end portion can be used for a wire wrap or printed wiring board connection. Thus, the connector of the present invention is "universal" in that a single connector can be used to make different kinds of connections.

Another embodiment of the invention provides a universal connector assembly which utilizes a conventional mounting block. The mounting block is formed of an electrically insulative material. Supported on the mounting block in a spaced apart relationship from one another are a plurality of electrically-conductive universal connectors, each connector being of the universal type discussed above. An exemplary connector assembly in accordance with this particular aspect of the invention has an elongated mounting block which has a plurality of parallel rows of universal connectors. The connectors have a first end extending from one side of the mounting block, and a second end extending from an opposite side of the mounting block. The universal connectors can be retained in the mounting block by way of a snap-fit mounting which is easy and economical to perform and thus advantageous to the manufacturing process.

BRIEF DESCRIPTION OF THE DRAWINGS

These and other features of the invention are delineated in detail in the following description and the accompanying drawings.

DETAILED DESCRIPTION

Figure 1:
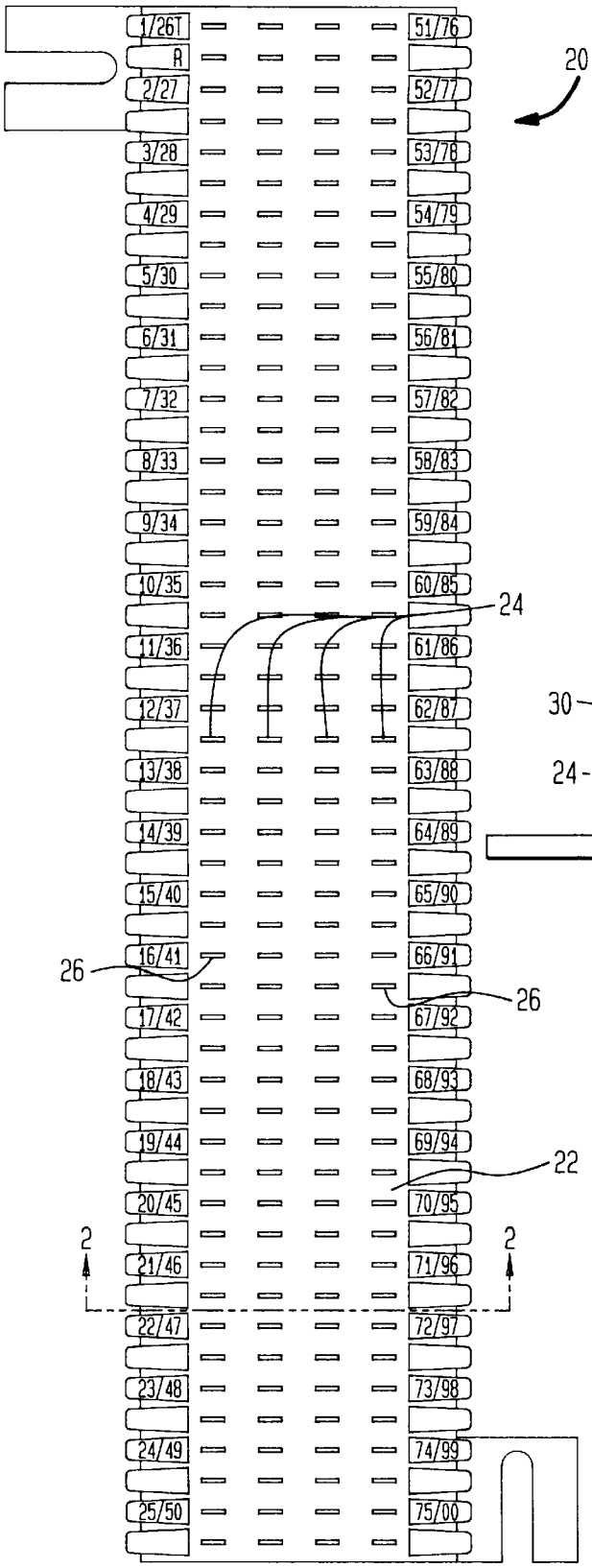
FIG. 1 (PRIOR ART)
FIG. 1 is a top view of a connector assembly of the type known in the prior art.
Figure 2:
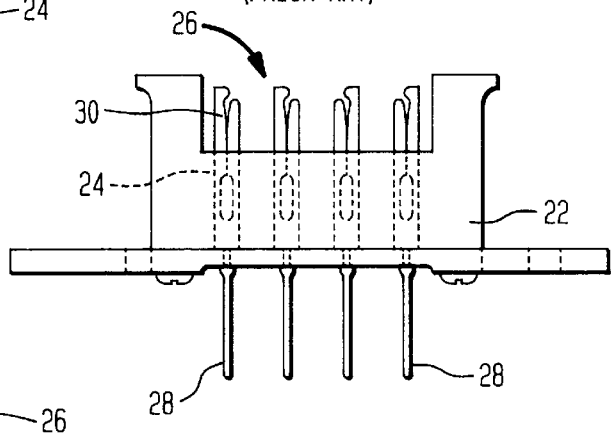
FIG. 2 (PRIOR ART)
FIG. 2 is a cross-sectional view of the connector assembly taken on line 2—2 of FIG. 1 showing connectors having an insulation displacement connector terminal on one end and a wire-tail terminal on an opposite end.

FIGS. 1 and 2 illustrate a type-66 connector assembly 20 of a type presently in widespread use. The connector assembly 20 comprises an elongated mounting block 22 formed of an electrically-insulative material such as polycarbonate. The mounting block 22 has a plurality of rows of openings 24 arranged in substantially parallel and spaced-apart groups as shown. The mounting block 22 can be found in different sizes and configurations depending on the desired use.

A plurality of electrically-conductive connectors 26 are supported on the mounting block 22, here being received and retained in the plurality of openings 24 in the mounting block 22. The connectors comprise a wire-tail terminal 28 on one end and an insulation displacement connector terminal 30 on the other end. Typically, all exposed ends of connectors 26 on the same side of the connector assembly 20 have the same terminal configuration. However, as shown in FIG. 2, the terminal configurations may not be the same on both sides of the connector assembly. Other type connectors (not shown) may have pin terminals on one or both sides, wire-tail terminals on both sides, etc.

Figure 3:
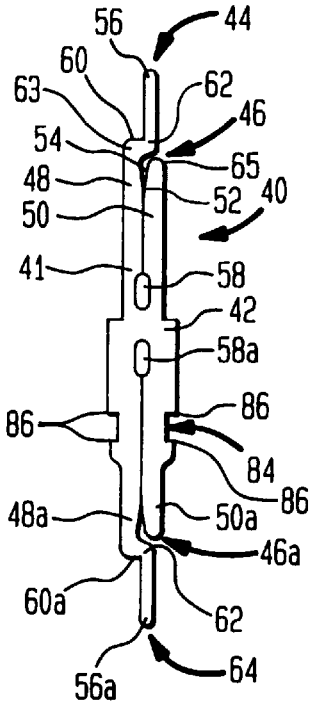
FIG. 3 is a plan view of an electrically-conductive universal connector in accordance with a preferred embodiment of the invention.

Referring now to FIG. 3, a preferred form of an electrically-conductive universal connector 40 in accordance with the present invention is shown. It has a universal terminal configuration on each end of the connector which is at once capable of forming either a wire-wrap, an IDC, or a printed wiring board connection.

The electrically-conductive universal connector 40 comprises a single piece, unitary body 41 formed from a relatively thin, flat, electrically-conductive material and has a base portion 42. The connector 40 has a first end 44 having a first pair 46 of wire-engaging tines 48, 50 protruding from the base portion 42 in side-by-side relationship. The tines 48, 50 are biased against separation from one another and define between them a wire-receiving slot 52. The wire-receiving slot 52 is configured for displacing insulation from and conductively gripping a wire positioned between the two tines 48, 50. The pair of tines 46 is further shaped to define a tool-engaging portion 54 for engagement by a tool used for inserting the wire into the wire-receiving slot 52.

Formed on the first tine 48 is a protruding portion 63 which extends at least partially over the free end 65 of the second tine as seen in FIG. 3.

The first tine 48 of the pair of tines 46 has a projecting end portion 56 shaped and extending beyond the second tine 50 a suitable length as shown to be capable of forming an electrically-conductive wire-wrap or printed wiring board connection. The projecting end portion 56 illustrated in FIG. 3 is suitable for use with either wire-wrap or printed wiring board connections.

In the preferred embodiment, the tines further define an opening 58 proximal to the juncture of the pair of tines 48, 50 with the base portion 42 to enhance the flexibility of the tines so that they may yield to accommodate a wire positioned therebetween. The first end 44 of the universal connector further comprises a shoulder 60 extending laterally from the first tine 48, the shoulder 60 being formed on the protruding portion 63 of the first tine 48 at a base 62 of the projecting end portion 56. The shoulder 60 serves a dual purpose as will be discussed hereinafter.

At the opposite or second end 64, the connector 40 further includes a second pair of wire-engaging tines 46*a* protruding from the base portion 42 opposite the first pair of tines 46. The second pair of tines 46*a* is preferably substantially the same as the first pair of tines 46, having similar elements, i.e., first and second tines 48*a*, 50*a*, a projecting portion 56*a*, a shoulder 60*a* at base 62*a*, an opening 58*a* proximal to the juncture of the pair of tines 46*a* with the base portion 42, a wire receiving slot 52*a*, etc. In the illustrated embodiment, the two ends 44, 64 are substantially mirror images of one another.

The universal connector 40 may be constructed of any suitable electrically-conductive material, a beryllium-copper material being preferred. Although the universal connector thickness may vary depending upon the application, a universal connector having a substantially uniform thickness in the range of 40–50 mils is preferred for connectors used in telecommunications applications. Additionally, although the projecting end portion 56 may vary somewhat in cross-section, a projecting end portion having a rectangular cross-section, such as a square cross-section, is preferred. The projecting end portion preferably has a length in the range of about ¼ inch to about ½ inch.

Figure 4:
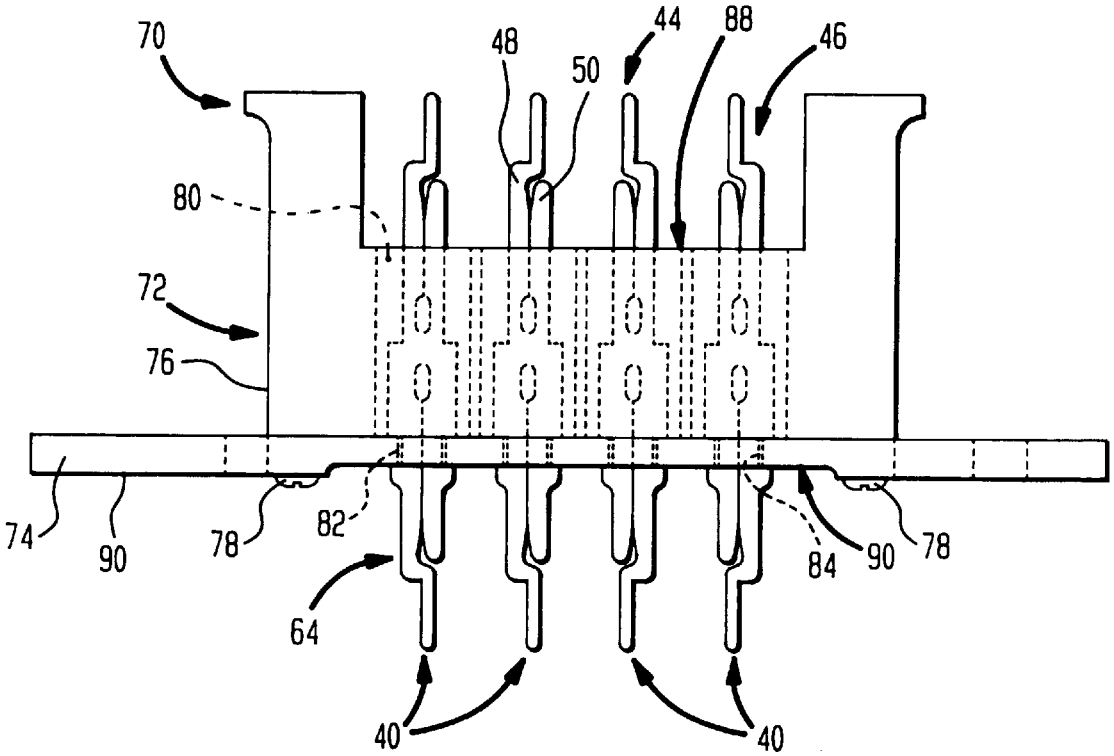
FIG. 4 is a cross-sectional view, oriented similarly to FIG. 2, illustrating a connector assembly in accordance with a preferred embodiment of the invention.

Referring to FIG. 4, a connector assembly 70 in accordance with an embodiment of the present invention is shown. The connector assembly 70 comprises an elongated mounting block 72 formed of an electrically-insulative material such as a polycarbonate plastic material. The mounting block 72 preferably includes a base plate 74 and a retaining block 76 releasably secured to the base plate 74 by screws 78. The retaining block 76 has a plurality of rows of connector receiving openings 80 arranged parallel and spacedapart from one another in a similar manner as shown in FIG. 1.

The base plate 74 has a plurality of openings 82 arranged to correspond to the openings 80 in the retaining block 76. A plurality of universal connectors 40 in accordance with the present invention are supported on the mounting block within the openings. In the illustrated embodiment, the connectors are retained in the mounting block 72 by a snap-fit mounting at the second end 64 of each universal connector 40, as shown in FIG. 4. Referring to FIG. 3, each connector 40 has a reduced neck portion 84 defined by two pairs of flanges 86 which cooperate to retain the connector 40 to the base plate 74. The connectors 40 are forcibly snap-fitted into the openings 82 of the base plate 74, as shown in FIG. 4. The base plate 74 may be constructed of any suitable material such as polycarbonate plastic which yields sufficiently to permit the connector 40 to be snap-fitted thereto.

Each opening 82 is dimensioned to retain the connector while providing sufficient clearance between the neck portion 84 and the opening 82 to permit yielding separation of the second pair of tines 46*a* when a wire conductor is positioned between them. Clearance is also provided between the openings 80 in the retaining block 76 and the first end 44 of the connector 40 for similar reasons, although a similar neck portion and flanges are unnecessary. Each pair of tines 46, 46*a* at each end 44, 64 of each connector 40 projects through respective openings 80, 82 of the retaining block 76 or base plate 74, the first end 44 extending from a first side 88 of the mounting block 72 (front side) and the second end 64 extending from the opposite side 90 (back side) as shown. The connectors 40 are preferably snap-fitted to the base plate 74 and then inserted into the retaining block 76 to form the connector assembly 70.

Figure 5:
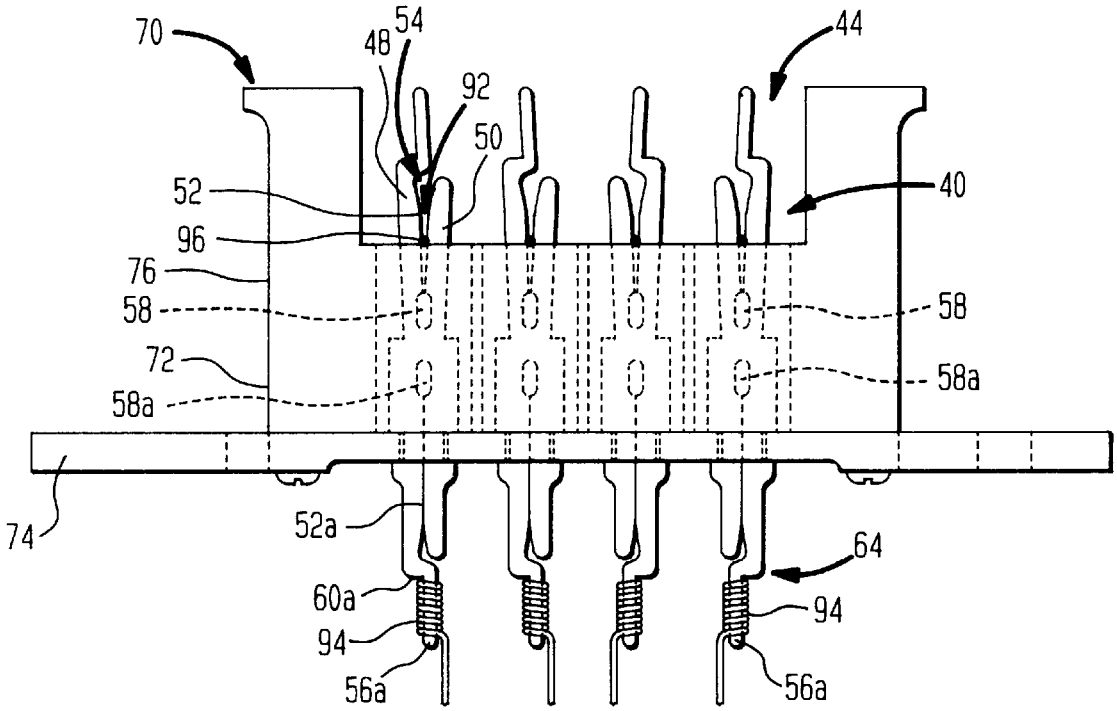
FIG. 5 is a cross-sectional view, similar to FIG. 4, illustrating an IDC connection on a first end of each universal connector and wire-wrap connection on a second end of each universal connector.

Either a wire-wrap, IDC or PWB connection may be formed at each end 44, 64 of each connector 40 to electrically couple two conductors. FIG. 5 shows a connector assembly 70 having IDC connections 92 formed at the first end 44 of each universal connector 40 and wire-wrap connections 94 formed at the second end 64. Each wire-wrap connection 94 is formed by an uninsulated portion of a wire conductor wrapped around the projecting end portion 56*a* as known in the art. The shoulder 60*a* can serve as a stop for the application of the wire-wrap gun and thereby ensure a proper connection. The shoulder also serves as a stop for a printed wiring board in a printed wiring board connection, as is discussed below.

IDC connections 92 are shown in FIG. 5 formed on the first end 44 of the universal connectors 40. The IDC connection is formed by urging the wire conductor 96 into the wire-receiving slot 52. The tines 48, 50, configured to displace the wire insulation (not shown), break away a portion of the insulation and conductively hold the conductor portion 96 of the wire between them as known in the art. The opening 58 adjacent the juncture of the tines 48, 50 facilitates the separation of the tines to accommodate the wire. The tines 48, 50, being relatively inflexible and therefore biased against separation, tightly grip and retain the wire conductor 96 in place. A tool such as the well-known D-impact tool can be used to facilitate the formation of an IDC connection, engaging the pair of tines at the tool-engaging portion 54.

Figure 6:
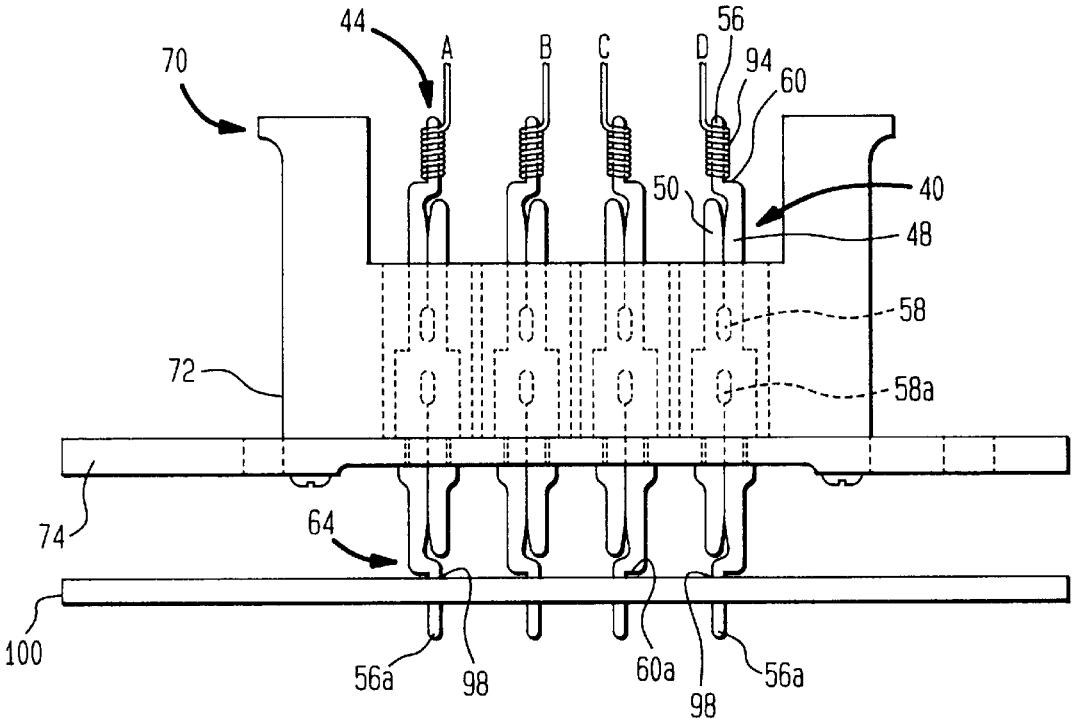
FIG. 6 is cross-sectional view, similar to FIGS. 4 and 5, illustrating a wire-wrap connection on a first end of each universal connector and a printed wiring board connection on a second end of each universal connector.

FIG. 6 shows a connector assembly 70 having wire-wrap connections 94 formed on each first end 44 of the connectors 40 and printed wiring board connections 98 formed on the second ends 64 of the connectors. FIG. 6 shows the formation of electrical connections between wires A, B, C, D and circuits of the printed wiring board 100. The wire wrap connections 94 are formed as described above. The electrical connections between the second ends 64 of the universal connectors 40 and the printed wiring board 100 are formed by inserting the projecting end portion 56*a*, serving as a pin terminal, into corresponding electrically-conductive openings in the printed wiring board 100. Preferably, each projecting end portion 56*a* extends through the thickness of the printed wiring board. The shoulder 60*a* serves as a stop for the printed wiring board 100. The projecting end portions 56*a* are preferably soldered to the circuits contacted on the printed wiring board 100 to form a secure connection.

As described, a connector assembly 70 having electrically-conductive universal connectors 40 is provided. Each universal connector 40 has a terminal configuration which can accommodate at least wire-wrap, IDC or printed wiring board connections. This reduces manufacturing and warehousing costs and provides a single connector assembly suitable to the needs of various end users.

Additional modifications will become apparent to those skilled in the art. All such variations which basically rely on the teachings through which the invention has advanced the art are properly considered within the scope of the invention.

What is claimed is:

1. A universal connector, comprising:

a unitary body formed from a relatively thin electrically-conductive material and having a base portion;

a first end having a first pair of tines protruding from said base portion and which includes a first and a second tine in side-by-side relationship to one another, said pair of tines being biased against separation from one another and defining therebetween a wire-receiving slot configured for displacing insulation from and conductively gripping a wire positioned there between, said second tine having a free end;

a protruding portion formed on said first tine and extending at least partially over said free end of said second tine; and a projecting end portion integrally attached to said protruding portion and extending beyond said protruding portion away from said second tine a suitable length to be capable of receiving a wire-wrap connection.

2. The universal connector of claim 1 further comprising a laterally extending shoulder formed on said protruding portion of said first tine at a base of the projecting end portion.

3. The universal connector of claim 2 wherein said projecting end portion extends lengthwise of said connector in at least partial alignment with said second tine.

4. The universal connector of claim 2 further comprising a second end which includes a second pair of tines protruding from said base portion opposite said first pair of tines.

5. The electrically-conductive connector of claim 4 wherein said first end is substantially a mirror image of said second end.

6. The universal connector of claim 2 wherein said projecting end portion has a substantially uniform cross-section along its length.

7. The universal connector of claim 6 wherein the connector has a thickness in the range of about 40 to about 50 mils.

8. The universal connector of claim 7 wherein the projecting end portion has a rectangular cross-section.

9. The universal connector of claim 1 further comprising a tool-engaging portion formed on said pair of tines for engaging a tool used to insert a wire into said wire receiving slot.

10. The universal connector of claim 1 further comprising a second end extending from said base portion opposite said first end and which is shaped to be capable of forming a wire-wrap connection.

11. A connector assembly comprising:

a mounting block formed of an electrically-insulative material;

a plurality of electrically-conductive universal connectors supported on said mounting block spaced from one another, and each of said plurality of electrically-conductive universal connectors having a unitary body formed from a relatively thin electrically-conductive material and having a base portion; a first end of said connector having a first pair of tines protruding from said base portion which includes a first and a second tine in side-by-side relationship to one another, said pair of tines being biased against separation from one another and defining therebetween a wire-receiving slot configured for displacing insulation from and conductively gripping a wire positioned there between, said second tine having a free end; said connectors further having a protruding portion formed on said first tine and extending at least partially over said free end of said second tine, a shoulder formed on said protruding portion, and a projecting end portion integrally attached to the protruding portion and extending beyond said shoulder away from said second tine a suitable length for forming an electrically-conductive wire-wrap connection with an electrical conductor.

12. The connector assembly of claim 11 wherein said shoulder extends laterally relative to said first tine.

13. The connector assembly of claim 11 wherein said projecting end portion of said first tine of each said connector extends lengthwise of said connector in at least partial alignment with said second tine.

14. The connector assembly of claim 11 wherein said first end of each universal connector extends from a first side of said mounting block, and wherein each of said connectors has a second end extending from an opposite side of said mounting block, each second end comprising a second pair of wire-engaging tines.

15. A universal electrical connector, comprising:

an electrically-conductive body having a base portion;

a first end protruding from said base portion and which includes a first and a second tine in side-by-side relationship to one another, said pair of tines being biased against separation from one another and defining therebetween a wire-receiving slot configured for displacing insulation from and conductively gripping a wire positioned there between, said second tine having a free end;

a protruding portion formed on said first tine and extending at least partially over said free end of said second tine;

a shoulder formed on said protruding portion; and a projecting end portion integrally attached to said protruding portion, said projecting portion extending beyond said shoulder away from said second tine a suitable length in at least partial alignment with said second tine to be capable of receiving a wire-wrap connection from a wire-wrap gun.

16. The universal connector of claim 15 wherein said projecting end portion has a length in the range of about ¼ inch to about ½ inch.

17. The universal connector of claim 16 wherein said shoulder extends laterally relative said first tine and is formed at a base of said projecting portion.

18. The universal connector of claim 17 further comprising a second end which includes a second pair of tines protruding from said base portion opposite said first pair of tines.

* * * * *